US007379394B2

(12) United States Patent
Ciervo

(10) Patent No.: US 7,379,394 B2
(45) Date of Patent: May 27, 2008

(54) SYSTEM AND METHOD FOR MODIFYING BUTTON FUNCTIONALITY

(75) Inventor: Richard D. Ciervo, New Britain, CT (US)

(73) Assignee: Timex Group B.V. (NL)

( * ) Notice: Subject to any disclaimer, the term of this patent is extended or adjusted under 35 U.S.C. 154(b) by 268 days.

(21) Appl. No.: 11/305,911

(22) Filed: Dec. 19, 2005

(65) Prior Publication Data

US 2007/0081424 A1 Apr. 12, 2007

Related U.S. Application Data

(60) Provisional application No. 60/725,792, filed on Oct. 12, 2005.

(51) Int. Cl.
*G04C 17/00* (2006.01)
*G04F 3/00* (2006.01)

(52) U.S. Cl. ..... 368/69; 368/96; 341/22; 341/26

(58) Field of Classification Search ..... 368/69, 368/107, 164, 320, 321; 341/22, 26; 340/825.69; 345/172, 156

See application file for complete search history.

(56) References Cited

U.S. PATENT DOCUMENTS

| | | | | |
|---|---|---|---|---|
| 5,796,680 | A * | 8/1998 | Franklin | 368/96 |
| 6,975,561 | B2 * | 12/2005 | Forsey et al. | 368/10 |
| 7,187,626 | B2 * | 3/2007 | Lizzi | 368/107 |
| 2002/0149704 | A1 * | 10/2002 | Kano et al. | 348/706 |

* cited by examiner

*Primary Examiner*—Truc T. Nguyen
*Assistant Examiner*—Thanh S. Phan
(74) *Attorney, Agent, or Firm*—Carmody & Torrance LLP

(57) ABSTRACT

An electronic device comprising a first pusher located in a first position on the electronic device, wherein actuation of the first pusher causes initiation of a first operational sequence; a second pusher located in a second position on the electronic device, wherein actuation of the second pusher causes initiation of a second operational sequence; an integrated circuit, operatively coupled to the first and second pushers, for selectively carrying out the first and second operational sequences; switching means for switching the operational sequences initiated by the first and second pushers such that subsequent to actuation of the switching means, the first pusher causes initiation of the second operational sequence and the second pusher causes initiation of the first operational sequence; whereby the first operational sequence is different from the second operational sequence.

10 Claims, 2 Drawing Sheets

"Left Wrist" Configuration

"Right Wrist" Configuration

"Left Wrist" Bezel Ring

"Right Wrist" Bezel Ring

SYSTEM AND METHOD FOR MODIFYING BUTTON FUNCTIONALITY

RELATED APPLICATIONS

This application claims the benefit of U.S. Provisional Application No. 60/725,792, filed Oct. 12, 2005.

BACKGROUND OF THE INVENTION

The present invention is directed to a system and method for modifying and/or altering the functionality of one or more buttons or pushers on an electronic device, wherein the electronic device is preferably a timepiece and a wristwatch in particular.

One perceived problem in the art today is the fact that certain electronic devices, such as digital watches as but one example, are designed with a particular configuration. For example, in a typical digital timepiece such as that described in U.S. Pat. No. 6,420,959, the functionality associated with particular buttons/pushers is non-changeable. By that it is meant, for example and as it relates to U.S. Pat. No. 6,420,959, that the S1 button is associated with the back-lighting and the S3 button is the mode selector, and such functionality associated with each button cannot change. Hence, a person wearing the device on her right wrist experiences a different interaction with the device than someone wherein the device on the left wrist. For example, with the device on the left wrist, a user may need to reach across the display to actuate a particular pusher for a particular function, while wearing the device on the left wrist may not require such a reach over. Obviously, other functions may require a reach over the display if the watch is worn on the opposite wrist. It would be desirable if such a perceived deficiency, namely removing any inconvenience associated with a dependency upon which wrist the device is worn, could be overcome.

Another but somewhat related perceived problem in the art today is a lack of customizability of small electronic devices such as, but not limited to timepieces, and wrist-watches in particular. For example, with the advancement of technology, such electronic devices (like digital watches) are becoming more powerful and increasingly complex, and manufacturers are trying to capitalize on this advancement by increasing the functionally of such products while actually limiting the variety of products being manufactured. In this way, manufactures are trying to simultaneously manufacture goods that appeal to a wider variety of consumers while trying to achieve this objective with a "do more with less" approach. However, to date, there is a perception that all that is being accomplished is the manufacture of products having advanced functionality not being appreciated by the novice and or intermediate users. Therefore, from an end-user's perspective, there is also a desire to try to manage and to make sense of all of the features present in today's typical small electronic devices. It would be desirable if such a perceived deficiency, namely the non-optimization of the functionality of such devices with the user's abilities/needs, could be overcome.

The present invention overcomes the aforementioned deficiencies. In a first embodiment, the present invention's novel construction and methodology is patentably different from the known uses of "soft keys" for electronic devices (where the functionality of a particular button can change depending on the operational mode or context) such as those employed in such devices as ATM's, cellphones and pagers.

In a second embodiment, the present invention discloses a novel construction and methodology whereby the user can specify her experience level with the device. She may choose the "novice" level where only the most basic modes and settings are accessible and/or actuatable and the device, e.g. a wristwatch, is simple to use. For example, all button functions may be push and release only and/or other modes (e.g. timer, chronograph) can be modified to only their most basic operation. As the user's experience with the device grows (or requirements change) the user may then set the watch for "expert" mode where all of the settings and modes are exposed. Other possibilities to modify the feature set also exist—"business" setting may turn off all sport features and add a number of alarm and appointment features; conversely a "sports" setting may do the exact opposite. More advanced devices may allow the user to customize her groups and settings.

As will be appreciated, the present invention is patentably different from known devices such as video games whose difficulty level can be modified based on a selection made at the start of the game (e.g. either "beginner" or "expert"), or a software installation program for a PC, whereby the user can select between differing approaches to downloading and storing (i.e. "normal" or "easy" vs. "custom") of the program. That is, if the user selects "custom" (or the equivalent "expert"), the user is permitted/required to specify more parameters of the installation.

Customization of the functional aspects of electronic devices, such as timepieces and wristwatches in particular, is desirable as doing so permits a wider degree of personalization of the device. Moreover, as technology develops, such functional changes become more acceptable and even expected by such users. Still further, what may have once been considered a "negative" (i.e. having the functionality of a watch change), may now be considered an "advantageous" feature and marketable. Still further, with the general public becoming more technologically "savvy," providing such electronic devices with such optional functionality will become less "scary" for the next generation of users of such devices.

Although the present invention incorporates user interface methodologies that should be generally known to those skilled in the art, the subject matter of U.S. Pat. Nos. 4,283,784; 4,783,773; 4,780,864; 5,555,226; 6,420,959; 6,604,851; 6,669,361 and 6,781,923; and that of pending application Ser. No. 09/727,886 is incorporated by reference as if fully set forth herein for completeness.

Accordingly, it is desirable to provide an electronic device that can still be further customized and more particularly configured to a user's customized, convenient and desired use thereof. The present invention achieves these objectives, as well as those mentioned above and within the remainder of this document.

SUMMARY AND OBJECTIONS OF THE INVENTION

It is thus an objective of the present invention to overcome the perceived deficiencies in the prior art.

Accordingly, it is an object of the present invention to provide an improved construction and methodology for an electronic device and, in particular, for a wristwatch, that allows a user to more particularly customize the functionality and configuration of the device.

It is another object and advantage of this invention to provide an improved construction and methodology for an electronic device and, in particular, for a wristwatch, that makes the device more "user friendly" to the user.

It is yet another object and advantage of this invention to provide an improved mode display methodology that makes the device more marketable to a wider range of users.

It is still another object and advantage of this invention to provide an improved construction and methodology for an electronic device and, in particular, for a wristwatch, that permits manufacturers, designers or programmers of such devices to further provide users with demanded functionality, yet provide a construction and methodology to permit the electronic device to be configured to better meet the users needs, desires and uses therefor.

It is a further object of the present invention to provide a multimode device that can provide additional mode capability and functionality.

Another object of the present invention is to provide a device having an improved multi-level user interface.

Further objects and advantages of this invention will become more apparent from a consideration of the drawings and ensuing description.

The invention accordingly comprises the features of construction, combination of elements, arrangement of parts and sequence of steps which will be exemplified in the construction, illustration and description hereinafter set forth, and the scope of the invention will be indicated in the claims.

Generally speaking, and in accordance with a first embodiment, the present invention is directed to an electronic device comprising a first pusher located in a first position on the electronic device, wherein actuation of the first pusher causes initiation of a first operational sequence; a second pusher located in a second position on the electronic device, wherein actuation of the second pusher causes initiation of a second operational sequence; an integrated circuit, operatively coupled to the first and second pushers, for selectively carrying out the first and second operational sequences; switching means for switching the operational sequences initiated by the first and second pushers such that subsequent to actuation of the switching means, the first pusher causes initiation of the second operational sequence and the second pusher causes initiation of the first operational sequence; whereby the first operational sequence is different from the second operational sequence.

Generally speaking and in accordance with a second embodiment, an electronic device is provided that selectively operates in a plurality of modes, wherein the electronic device comprises an integrated circuit operable in the plurality of modes and wherein the plurality of modes comprises at least a level selecting mode, a first level mode and a second level mode, wherein the electronic device comprises actuation means for operating the electronic device in the first mode and in the second mode, wherein in the first mode the integrated circuit operates in accordance with a first set of instruction codes and wherein in the second mode the integrated circuit operates in accordance with a second set of instruction codes; and level selecting means for causing (operatively signaling) the integrated circuit to selectively operate in the first mode and the second mode; wherein in the first mode, actuation of the actuation means causes the electronic device to perform a first set of functions; and wherein in the second mode, actuation of the actuation means causes the electronic device to perform a second set of functions; whereby the second set of functions are different from or in addition to the first set of functions.

Methodologies for carrying out the present invention are also provided herein. In the preferred embodiment, the electronic device is a wristwatch.

BRIEF DESCRIPTION OF THE DRAWINGS

For a fuller understanding of the invention, reference is had to the following description taken in connection with the accompanying figures, in which.

DETAILED DESCRIPTION OF THE PREFERRED EMBODIMENTS

As indicated above, the button layout for a device (e.g. and in particular, a digital watch) is typically fixed and the function for each of the buttons is determined during the development of the watch. More often than not the watch is designed so that the button placement favors those who wear the watch on the left wrist and operate it with the right hand, which leads to an undesirability if the wearer wishes to wear the watch on the right wrist, as the button layout then becomes less than optimal, and operating the watch is cumbersome. The present invention, in accordance with a first embodiment, aims to allow the user to wear the watch on either wrist and enjoy the ease of use intended by the manufacturer.

Therefore, reference is first made to FIG. 1, which generally illustrates a first implementation of the first embodiment of the present invention. In this software configuration implementation, the button functions may be indicated by text in the LCD, similar to the known "setting reminders" function existing in one or more "Timex" branded watches. The watch thus preferably would employ a "Left/Right" setting in one of the modes. When configured for "Left," for example, one set of button function labels is visible and the buttons correspond to those functions. On the other hand, when set for "Right," the labels and functions are adjusted accordingly.

Figure 2:
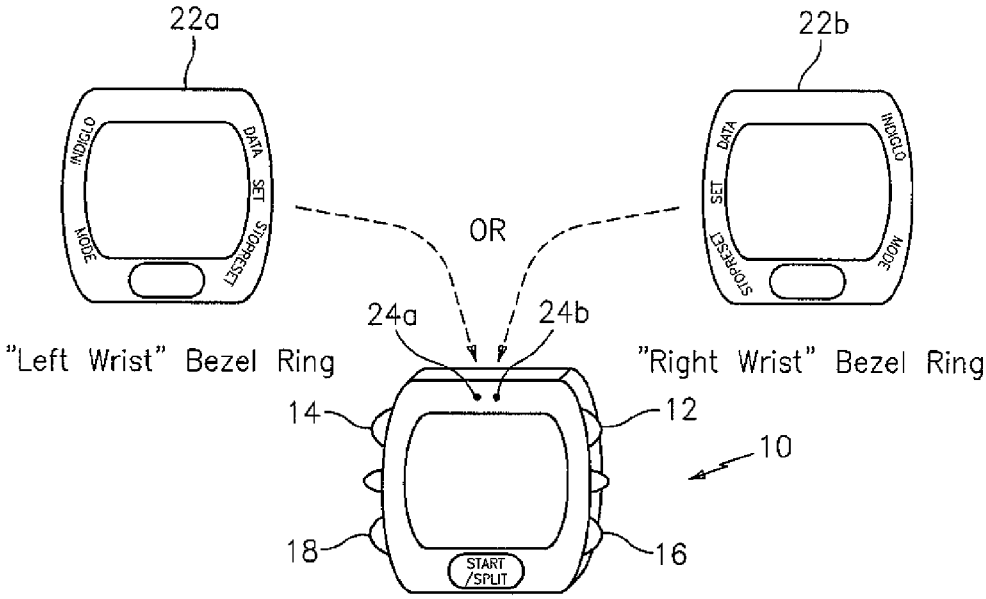
FIG. 2 illustrates an electronic device constructed in accordance with an alternative of the first embodiment of the present invention.

On the other hand and as generally indicated in FIG. 2, in a second mechanical configuration implementation, the button function labels may be painted, silk-screened and/or otherwise provided onto two different bezel rings included with the watch—one labeled (e.g.) "Right" and the other (e.g.) "Left." An assembly comprising a pin and electrical contact may be employed in the watch to determine which of the rings has been snapped onto the case, thereby modifying the button functions to correspond to the labels on the ring. Still further contemplated, a variant of this construction contemplates a single, permanently affixed bezel ring to be rotated from one position to another to switch between and/or otherwise indicate a "left" or "right" configuration.

Reference shall now be made to the specifics of FIGS. 1 and 2, both of which illustrate an electronic device generally indicated at 10, constructed in accordance with the present invention.

An electronic device configured in accordance with the present invention preferably comprises a first pusher 12 located in a first (e.g. upper right) position on casing 11 of electronic device 10. As would be understood by those skilled in the art and from a reading of those patents incorporated by reference herein, actuation of first pusher 12 causes initiation of a first operational sequence, which in the illustrated example of FIG. 1, may be the display of data in a selected mode.

Electronic device 10 also preferably comprises at least a second pusher 14 located in a second (e.g. upper left) position on casing 11 of electronic device 10. Similarly, actuation of the second pusher causes initiation of a second operational sequence, which in the present illustrated example, relates to the initiation of a sequence to illuminate the backlight.

To selectively carry out the first and second operational sequences, an integrated circuit (FIG. 3), which is operatively coupled to the first and second pushers, is provided for selectively carrying out the first and second operational sequences.

The electronic device 10 of both the implementations of FIGS. 1 and 2 comprise switching means for switching the operational sequences initiated by the first and second pushers, such that subsequent to actuation of the switching means, first pusher 12 causes initiation of the second operational sequence and second pusher 14 causes initiation of the first operational sequence. In other words, the functions carried out by actuation of first pusher 12 and second pusher 14 are switched.

To best appreciate the advantageousness of the present invention, it should be clear (and is illustrated) that first pusher 12 is located on a first side of casing 11 and second pusher 14 is located on the second (i.e. opposite) side of casing 11. To be sure, opposite need only be on the other side, specific positioning at the upper or lower position is not required. However, to be sure, this is but the preferred implementation, as merely switching the functions of an upper right button with that of a lower right button is within the scope of the present invention. Thus, in yet a further implementation of this first embodiment, electronic device 10 may further comprise yet a third pusher 16 located in a third (e.g. lower right) position on electronic device 10, wherein actuation of third pusher 16 causes initiation of a yet a third operational sequence (e.g. initiation of a stop/reset set of instructions) and a fourth pusher 18 located in a fourth (e.g. lower left) position on electronic device 10, wherein actuation of fourth pusher 18 causes initiation of a fourth operational sequence (e.g. a mode selection sequence) (see FIG. 1A).

Figure 1A:
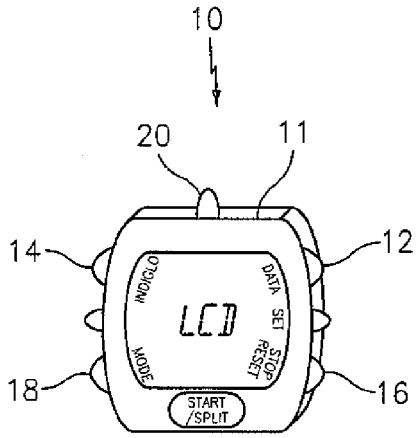
FIGS. 1A and 1B illustrate an electronic device of the present invention in accordance with a first embodiment.
Figure 1B:
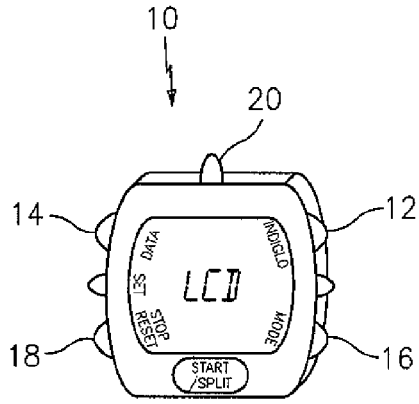

Again, the integrated circuit selectively carries out both the third and fourth operational sequences such that subsequent to actuation of the switching means, the third pusher causes initiation of the fourth operational sequence and the fourth pusher causes initiation of the third operational sequence (see FIG. 1B).

In the embodiment illustrated in FIGS. 1A and 1B, electronic device 10 selectively (i.e. one mode at a time) operates in a plurality of modes, wherein the integrated circuit is operable in the plurality of modes. The plurality of modes comprises at least a configuration selecting mode, a first (e.g. "Right-handed") mode and a second ("Left-handed") mode, wherein in the first mode (FIG. 1A), actuation of first pusher 12 initiates the first operational sequence (e.g. data display) and actuation of second pusher 14 initiates the second operational sequence (e.g. backlighting) and wherein in the second mode (FIG. 1B), actuation of first pusher 12 initiates the second operational sequence and actuation of second pusher 14 initiates the first operational sequence.

The switching means causes the integrated circuit to selectively switch between operating in the first mode and the second mode, whereby in the first mode, actuation of the first pusher causes the electronic device to perform a first set of function(s) and actuation of the second pusher causes the electronic device to perform a second set of function(s); and in the second mode, actuation of the first pusher causes the electronic device to perform the second set of function(s) and actuation of the second pusher causes the electronic device to perform the first set of function(s).

More specifically, one of the plurality of modes is a mode selecting mode, and wherein in the mode selecting mode, the electronic device cycles among at least the configuration selecting mode, the first mode and the second mode; and wherein in the configuration selecting mode, actuation of the switching means causes the integrated circuit to switch between operation in the first mode and the second mode. In the embodiment of FIGS. 1A and 1B, the switching means comprises one or more pushers that are operatively coupled to the integrated circuit, wherein actuation of the switching means to switch the electronic device from operating in the first mode to the second mode causes the integrated circuit to initiate the first operational sequence when the second pusher is actuated and to initiate the second operational sequence when the first pusher is actuated; and actuation of the switching means to switch the electronic device from operating in the second mode to the first mode causes the integrated circuit to initiate the second operational sequence when the second pusher is actuated and to initiate the first operational sequence when the first pusher is actuated.

Alternatively, a dedicated pusher, such as pusher 20 may be used to switch between the "Right-handed" and "Left-handed" modes. Pusher 20 is merely shown on top of casing 11 for convenience, and it could be located elsewhere, as its position is merely one of design choice.

Reference is also made to FIG. 2, wherein electronic device 10 is illustrated as being able to selectively receive two (2) bezel rings, namely 22*a* and 22*b*. As an exemplary embodiment, electrical contacts 24*a* and 24*b* are provided in casing 11, with each bezel ring being provided with a electrical pin that engages one or the other contact, so as to permit the integrated circuit to "know" which bezel ring is provided on casing 11. Depending on which electrical contact is being made, integrated circuit will operate in the first or second mode as set forth above. For simplicity, electrical contacts 24*a*, 24*b* may simply be essentially pushers that make electrical contact with a pad inside casing 11. This configuration may be simpler to design and more resistant to corrosion issues. Thus, in this specific implementation, the switching means is differing bezel rings.

In both the implementations of FIGS. 1A, 1B and FIG. 2, it should thus be understood that a subsequent actuation of the switching means (whether by pusher or use of a different bezel ring) causes subsequent actuation of first pusher 12 to cause initiation of the first operational sequence and subsequent actuation of second pusher 14 to cause initiation of the second operational sequence. In other words, if, while in the configuration ("Left/Right") selecting mode, the user switches back to the "Right" mode (from the "Left" mode), the operational sequences initiated by the pushers return to that which is illustrated in FIG. 1A. Likewise, in a four pusher configuration (e.g. including at least pushers 12, 14, 16 and 18), a subsequent actuation of the switching means causes subsequent actuation of the third pusher to cause initiation of the third operational sequence and subsequent actuation of the fourth pusher to cause initiation of the fourth operational sequence.

Figure 3:
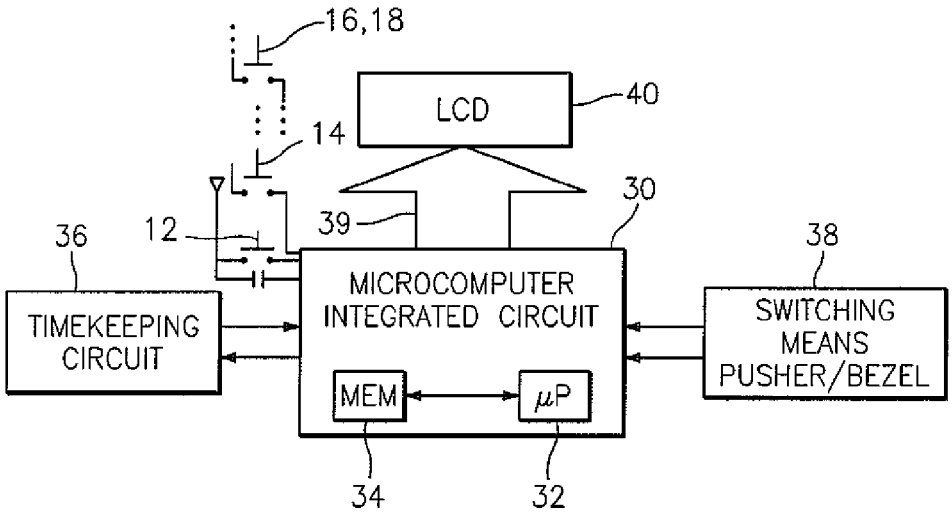
FIG. 3 is a simplified block diagram of the circuitry of the first embodiment.

FIG. 3 illustrates a circuit block diagram of a multimode, multifunction electronic timepiece 10 configured in accordance with the first embodiment of the present invention.

The circuitry is disposed within a cavity of casing 11 and may be operable for performing, among other things, timekeeping functions as well as all functions and operational sequences set forth herein and in those patents and applications incorporated by reference herein.

The circuitry includes a programmable microcomputer 30 in the form of an integrated circuit chip. The microcomputer 30 includes a microprocessor 32 programmed to perform instructions suitable for achieving the timekeeping functions and all the mode selecting and operating as disclosed above. The microcomputer also includes a memory device 34. The memory device 34 may store, for example, data values and/or variables used by the microprocessor 32 in the operating modes set forth herein. In particular, the memory device may store the electronic timepiece setting and mode selecting methodologies, as well as the operational sequences as software routines retrieved and executed by microprocessor 32 in accordance with the present invention. As can be appreciated, the circuitry may also include a timekeeping circuit 36, which generates time indicating signals representing, among other things, a time-of-day. Signals from the timekeeping circuit 36 as well as other signals from, for example, switching mean 38, whether in the form of interchangeable bezel rings or switching means comprising one or more pushers (e.g. pusher 20), are processed by the microcomputer 30. The signals are passed to the microprocessor 32 for processing to change, for example, the modes between the first ("Right-handed") mode and second ("Left-handed") mode. Other details of the workings of the device, such as backlighting and carrying out of the operational sequences, are well known in the art so that no further details need be made thereto. Output signals via a display bus 39 are provided to a display such as, for example, a liquid crystal display 40. LCD 40 exhibits the time of day, other time measuring quantities, and other information as set forth and indicated above and/or as instructed by the microcomputer 30.

Lastly, while the foregoing is a somewhat simplified circuit diagram, it is believed to be sufficient for proposes of ensuring enablement and complying with the best mode requirements for the present invention, especially in view of the knowledge of the ordinarily skilled artisan and those documents incorporated by reference herein.

Figure 4:
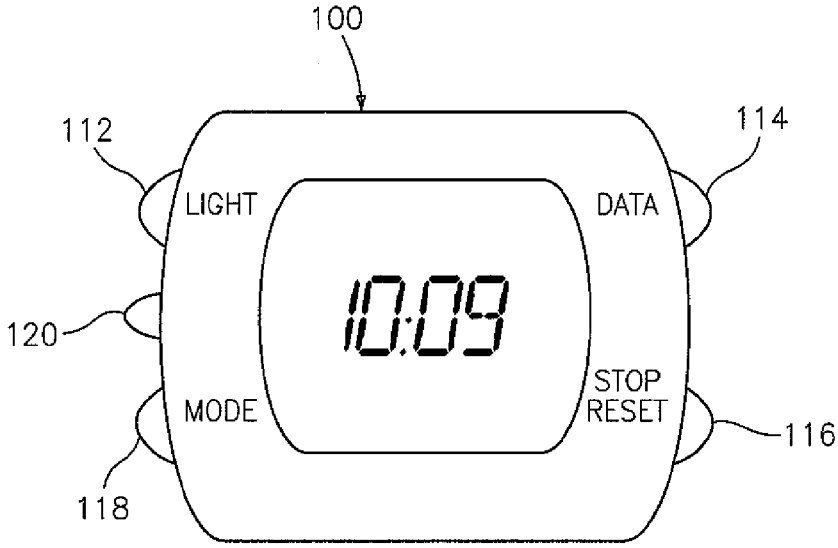
FIG. 4 illustrates an electronic device in accordance with a second embodiment of the present invention.

Reference is now made to FIG. 4, wherein an electronic device 100, constructed in accordance with a second embodiment of the present invention, is provided. Generally speaking, in this second embodiment, electronic device 100 also selectively operates in a plurality of modes, wherein the electronic device comprises an integrated circuit operable in the plurality of modes and wherein the plurality of modes comprises at least a level selecting mode (e.g. to select between a "novice" and an "advanced" and/or "expert" mode), a first level (e.g. "novice") mode and a second level (e.g. "advanced") mode. In accordance with the preferred embodiment, electronic device 100 comprises (i) actuation means for operating the electronic device in the first mode and in the second mode, wherein in the first mode the integrated circuit operates in accordance with a first set of instruction codes and wherein in the second mode the integrated circuit operates in accordance with a second set of instruction codes; and (ii) level selecting means for causing the integrated circuit to selectively operate in the first mode and the second mode; wherein in the first mode, actuation of the actuation means causes the electronic device to perform a first set of functions; and wherein in the second mode, actuation of the actuation means causes the electronic device to perform a second set of functions; whereby the second set of functions are different from or in addition to the first set of functions.

In the preferred embodiment, the actuation means comprises one or more pushers (e.g. pushers 112, 114, 116 and/or 118) that are operatively coupled to the integrated circuit, wherein actuation of the pushers while the electronic device is in the first mode causes the performance of the first set of functions and wherein actuation of the pushers while the electronic device is in the second mode causes the performance of the second set of functions.

In the preferred embodiment, the level selecting means may comprise a separate and optionally dedicated pusher (e.g. pusher 120) that is operatively coupled to the integrated circuit, wherein actuation of the level selecting means causes the integrated circuit to switch between operation in the first mode and the second mode.

Alternatively, one of the plurality of modes in which the electronic device may operate is a mode selecting mode, and wherein in the mode selecting mode, the electronic device cycles among at least the level selecting mode, the first mode and the second mode; and wherein in the level selecting mode, actuation of the level selecting means (i.e. a pusher, but not necessarily a dedicated pusher) causes the integrated circuit to switch between being operational in the first mode and the second mode.

To be sure, the integrated circuit may be operable in at least a third (e.g. "expert") mode; and the actuation means provides for operating the electronic device in the third mode, wherein in the third mode the integrated circuit operates in accordance with a third set of instruction codes; wherein the level selecting means causes the integrated circuit to selectively operate in the third mode and wherein in the third mode, actuation of the actuation means causes the electronic device to perform a third set of functions; and whereby the third set of functions are different from or in addition to the second set of functions.

Lastly, as set forth above, operating in the "novice," "advanced" and/or "expert" is but one example of the versatility of the present invention. Alternatively, the one or more modes could comprise a "sports," "business" and/or "personal" mode, just to name a few.

Likewise, the level selecting means could likewise comprise multiple bezel rings as set forth above with respect to the first embodiment, such that operative coupling of different bezel rings to the casing likewise causes the integrated circuit to operate in the various modes.

Thus to the extent necessary, the circuit of FIG. 3 is likewise applicable to the second embodiment set forth in FIG. 4.

It can thus be seen that the present invention provides an improvement in functionality over prior art multimode electronic devices and, in particular, in a wristwatch, that allows the electronic device to customize itself to the use, desires and capabilities of the user. Further, by implementing the present invention, an improved construction and methodology for such electronic devices that makes the device more "user friendly" and customizable to the user is provided. Still further, the present invention provides a user interface and improved functionality that makes the device more marketable to a wider range of users. Lastly (but not exhaustively), the present invention permits manufacturers, designers or programmers of such devices to further provide users with demanded functionality, yet provide a construction and methodology to permit the electronic device to configure itself to better meet the users needs, desires and uses therefor.

It is also to be understood that the following claims are intended to cover all of the generic and specific features of the invention described herein and all statements of the scope of the invention which as a matter of language might fall therebetween.

What is claimed is:

1. An electronic device, comprising:

a casing;

a first pusher located in a first position on the casing, wherein actuation of the first pusher causes initiation of a first operational sequence;

a second pusher located in a second position on the casing, wherein actuation of the second pusher causes initiation of a second operational sequence;

an integrated circuit, operatively coupled to the first and second pushers, for selectively carrying out the first and second operational sequences;

switching means for switching the operational sequences initiated by the first and second pushers such that subsequent to actuation of the switching means, the first pusher causes initiation of the second operational sequence and the second pusher causes initiation of the first operational sequence;

whereby the first operational sequence is different from the second operational sequence;

wherein the electronic device is a wristwatch.

2. The electronic device as claimed in claim 1, wherein a subsequent actuation of the switching means causes subsequent actuation of the first pusher to cause initiation of the first operational sequence and subsequent actuation of the second pusher to cause initiation of the second operational sequence.

3. The electronic device as claimed in claim 1, wherein:

the first pusher is located on a first side of the casing; and the second pusher is located on the second side of the casing.

4. The electronic device as claimed in claim 1, further comprising:

a third pusher located in a third position on the casing, wherein actuation of the third pusher causes initiation of a third operational sequence;

a fourth pusher located in a fourth position on the casing, wherein actuation of the fourth pusher causes initiation of a fourth operational sequence;

wherein the integrated circuit selectively carries out both the third and fourth operational sequences such that subsequent to actuation of the switching means, the third pusher causes initiation of the fourth operational sequence and the fourth pusher causes initiation of the third operational sequence.

5. The electronic device as claimed in claim 4, wherein a subsequent actuation of the switching means causes subsequent actuation of the third pusher to cause initiation of the third operational sequence and subsequent actuation of the fourth pusher to cause initiation of the fourth operational sequence.

6. The electronic device as claimed in claim 4, wherein:

the first pusher is located on a first side of the casing;

the third pusher is located on the first side of the casing;

the second pusher is located on a second side of the casing; and the fourth pusher is located on the second side of the casing.

7. The electronic device as claimed in claim 1, wherein the electronic device selectively operates in a plurality of modes, wherein the integrated circuit is operable in the plurality of modes and wherein the plurality of modes comprises at least a configuration selecting mode, a first mode and a second mode, wherein in the first mode actuation of the first pusher initiates the first operational sequence and actuation of the second pusher initiates the second operational sequence and wherein in the second mode actuation of the first pusher initiates the second operational sequence and actuation of the second pusher initiates the first operational sequence; and wherein the switching means causes the integrated circuit to selectively switch between operating in the first mode and the second mode;

whereby:

in the first mode, actuation of the first pusher causes the electronic device to perform a first set of functions and actuation of the second pusher causes the electronic device to perform a second set of functions; and in the second mode, actuation of the first pusher causes the electronic device to perform the second set of functions and actuation of the second pusher causes the electronic device to perform the first set of functions.

8. The electronic device as claimed in claim 7, wherein one of the plurality of modes is a mode selecting mode, and wherein in the mode selecting mode, the electronic device cycles among at least the configuration selecting mode, the first mode and the second mode; and wherein in the configuration selecting mode, actuation of the switching means causes the integrated circuit to switch between operation in the first mode and the second mode.

9. The electronic device as claimed in claim 1, wherein the switching means comprises one or more pushers that are operatively coupled to the integrated circuit, wherein:

actuation of the switching means to switch the electronic device from operating in a first mode to a second mode causes the integrated circuit to initiate the first operational sequence when the second pusher is actuated and to initiate the second operational sequence when the first pusher is actuated; and actuation of the switching means to switch the electronic device from operating in the second mode to the first mode causes the integrated circuit to initiate the second operational sequence when the second pusher is actuated and to initiate the first operational sequence when the first pusher is actuated.

10. The electronic device as claimed in claim 1, wherein the switching means comprises one or more bezel rings that are operatively coupled to the casing, wherein the operative coupling of the one or more bezel rings to the casing causes the switching of the electronic device from operating in a first mode to a second mode thus causing the integrated circuit to initiate the first operational sequence when the second pusher is actuated and to initiate the second operational sequence when the first pusher is actuated; and operatively coupling a different bezel ring to the casing causes the electronic device to switch from operating in the second mode to the first mode and causes the integrated circuit to initiate the second operational sequence when the second pusher is actuated and to initiate the first operational sequence when the first pusher is actuated.

* * * * *